US009600973B2

(12) United States Patent
Naylor et al.

(10) Patent No.: US 9,600,973 B2
(45) Date of Patent: Mar. 21, 2017

(54) PROXY SPOTS FEATURE FOR KENO GAMES

(71) Applicant: IGT, Las Vegas, NV (US)

(72) Inventors: Toby F. Naylor, Belgrade, MT (US); Jerry L. Byrd, Bozeman, MT (US)

(73) Assignee: IGT, Las Vegas, NV (US)

( * ) Notice: Subject to any disclaimer, the term of this patent is extended or adjusted under 35 U.S.C. 154(b) by 506 days.

(21) Appl. No.: 14/033,088

(22) Filed: Sep. 20, 2013

(65) Prior Publication Data

US 2015/0087379 A1 Mar. 26, 2015

(51) Int. Cl.
*G07F 17/32* (2006.01)

(52) U.S. Cl.
CPC ..... *G07F 17/3286* (2013.01); *G07F 17/326* (2013.01); *G07F 17/329* (2013.01)

(58) Field of Classification Search
CPC ..... A63F 3/06; A63F 3/0605; A63F 3/061; A63F 3/062; G07F 17/329; G07F 17/34; G07F 17/3213; G07F 17/3244
See application file for complete search history.

(56) References Cited

U.S. PATENT DOCUMENTS 4,033,588 A 7/1977 Watts
4,611,811 A 9/1986 Haase
4,661,906 A 4/1987 DiFrancesco et al.
4,711,454 A 12/1987 Small
4,747,600 A 5/1988 Richardson
4,775,155 A 10/1988 Lees
4,798,387 A 1/1989 Richardson
4,875,686 A 10/1989 Timms
5,005,840 A 4/1991 Schwartz
5,043,887 A 8/1991 Richardson
5,046,737 A 9/1991 Fienberg
5,072,381 A 12/1991 Richardson et al.
5,100,139 A 3/1992 Di Bella
5,116,049 A 5/1992 Sludikoff et al.
5,158,293 A 10/1992 Mullins
5,351,970 A 10/1994 Fioretti
5,401,024 A 3/1995 Simunek
5,419,592 A 5/1995 Stuart
(Continued)

OTHER PUBLICATIONS

"The Everything Casino Gambling Book," 2nd ed., by Med Elaine Schneider, Adams Media, 2004, chapter on keno.*

*Primary Examiner* — Omkar Deodhar
*Assistant Examiner* — Matthew D. Hoel
(74) *Attorney, Agent, or Firm* — Neal, Gerber & Eisenberg LLP

(57) ABSTRACT

A method is provided for playing a keno game that allows for selection of proxy spots in addition to standard spots. A keno board is displayed showing a set of available numbers. A set of numbers is selected. The set of selected numbers is a sub-set of available numbers, and the selected set comprising a first sub-set of numbers and a second sub-set of numbers. For each number in the first sub-set of numbers, a number from the second sub-set of numbers is selected to link to the number in the first sub-set of numbers. A set of drawn numbers from the set of available numbers is selected. Hits are determined by comparing the first sub-set of numbers and the second sub-set of numbers and the drawn numbers. Payout is calculated based on the determined hits.

13 Claims, 4 Drawing Sheets

(56) References Cited

U.S. PATENT DOCUMENTS 5,482,289 A 1/1996 Weingardt
5,569,083 A 10/1996 Fioretti
5,586,937 A 12/1996 Menashe
5,639,089 A 6/1997 Matsumoto et al.
5,647,798 A 7/1997 Falciglia
5,651,735 A * 7/1997 Baba ..... G07F 17/3244 463/18
5,679,077 A 10/1997 Pocock et al.
5,687,971 A 11/1997 Khaladkar
5,718,631 A 2/1998 Invencion
5,727,786 A 3/1998 Weingardt
5,743,526 A 4/1998 Inoue
5,755,619 A 5/1998 Matsumoto et al.
5,779,545 A 7/1998 Berg et al.
5,813,911 A 9/1998 Margolin
5,823,534 A 10/1998 Banyai
5,857,911 A 1/1999 Fioretti
5,871,398 A 2/1999 Schneier et al.
5,909,875 A 6/1999 Weingardt
5,935,001 A 8/1999 Baba
5,935,002 A 8/1999 Falciglia
5,945,655 A 8/1999 Gilgeous et al.
6,017,032 A 1/2000 Grippo et al.
6,024,640 A 2/2000 Walker et al.
6,079,711 A 6/2000 Wei et al.
6,099,407 A 8/2000 Parker et al.
6,102,400 A 8/2000 Scott et al.
6,146,272 A 11/2000 Walker et al.
6,168,521 B1 1/2001 Luciano et al.
6,183,361 B1 2/2001 Cummings et al.
6,210,276 B1 4/2001 Mullins
6,220,961 B1 4/2001 Keane et al.
6,241,606 B1 6/2001 Riendeau et al.
6,250,685 B1 6/2001 Walker et al.
6,257,980 B1 7/2001 Santini, Jr.
6,315,290 B1 11/2001 Roethel et al.
6,315,291 B1 11/2001 Moody
6,325,716 B1 12/2001 Walker et al.
6,358,151 B1 3/2002 Enzminger et al.
6,364,313 B1 4/2002 Moody
6,368,213 B1 4/2002 McNabola
6,368,214 B1 * 4/2002 Luciano ..... A63F 1/00 273/138.1
6,398,644 B1 6/2002 Perrie et al.
6,398,646 B1 6/2002 Wei et al.
6,402,614 B1 6/2002 Schneier et al.
6,425,823 B1 7/2002 Byrne
6,478,677 B1 11/2002 Moody
6,482,088 B2 11/2002 Santini, Jr.
6,514,144 B2 2/2003 Riendeau et al.
6,524,184 B1 2/2003 Lind et al.
6,524,185 B2 2/2003 Lind
6,533,660 B2 3/2003 Seelig et al.
6,565,091 B2 5/2003 Weingardt
6,569,017 B2 5/2003 Enzminger et al.
6,581,935 B1 6/2003 Odom
6,585,590 B2 7/2003 Malone
6,599,188 B2 7/2003 Hirsch et al.
6,607,440 B2 8/2003 Santini, Jr.
6,609,973 B1 8/2003 Weiss
6,645,072 B1 11/2003 Kellen
6,656,044 B1 12/2003 Lewis
6,656,045 B2 12/2003 Wei et al.
6,722,655 B1 4/2004 Camero
6,755,738 B2 6/2004 Glasson et al.
6,755,739 B2 6/2004 Santini, Jr.
6,780,108 B1 8/2004 Luciano et al.
6,802,776 B2 10/2004 Lind et al.
6,824,465 B2 11/2004 Luciano, Jr.
6,832,956 B1 12/2004 Boyd et al.
6,840,858 B2 1/2005 Adams
7,258,608 B2 8/2007 Khal
7,303,469 B2 12/2007 Kaminkow
7,306,519 B2 12/2007 Baerlocher
7,399,227 B2 7/2008 Michaelson et al.
7,544,129 B2 6/2009 Baerlocher
7,682,241 B2 3/2010 Baerlocher
7,824,257 B2 11/2010 Jubinville et al.
7,901,282 B2 3/2011 Cannon
8,025,561 B2 9/2011 Reddicks et al.
2002/0045472 A1 4/2002 Adams
2002/0052231 A1 5/2002 Fioretti
2002/0094859 A1 7/2002 Hirsch et al.
2002/0098883 A1 7/2002 Packes et al.
2002/0111207 A1 8/2002 Lind et al.
2002/0111214 A1 8/2002 Lind et al.
2002/0113369 A1 8/2002 Weingardt
2002/0117803 A1 8/2002 Weingardt
2002/0137562 A1 9/2002 Malone
2002/0155877 A1 10/2002 Enzminger et al.
2002/0169018 A1 11/2002 Schneier et al.
2002/0177478 A1 11/2002 Glasson et al.
2003/0017867 A1 1/2003 DeKeller
2003/0127793 A1 7/2003 Adams
2003/0144050 A1 7/2003 Keaton et al.
2003/0171986 A1 9/2003 Itkis et al.
2003/0178771 A1 9/2003 Banyai
2003/0181234 A1 9/2003 Falciglia, Sr.
2003/0193136 A1 10/2003 Walker et al.
2003/0195032 A1 10/2003 Enzminger et al.
2004/0009806 A1 1/2004 Odom
2004/0048647 A1 3/2004 Lind et al.
2004/0053669 A1 3/2004 Gerrard et al.
2004/0106445 A1 6/2004 Perrie et al.
2004/0121834 A1 6/2004 Libby et al.
2004/0130096 A1 7/2004 Duhamel
2004/0152499 A1 8/2004 Lind et al.
2004/0166920 A1 8/2004 Boyd et al.
2004/0176169 A1 9/2004 Lind et al.
2004/0178579 A1 9/2004 Lowell et al.
2004/0204225 A1 10/2004 Campo et al.
2004/0214626 A1 10/2004 Lind et al.
2004/0235555 A1 11/2004 Yarbrough et al.
2004/0242310 A1 12/2004 Perkins
2004/0251628 A1 12/2004 Kilby
2004/0266509 A1 12/2004 Bennett et al.
2005/0054404 A1 3/2005 Baerlocher
2005/0054415 A1 3/2005 Kaminkow et al.
2005/0059449 A1 3/2005 Yarbrough
2005/0059467 A1 3/2005 Saffari et al.
2005/0059468 A1 3/2005 Cannon
2005/0059469 A1 3/2005 Gail et al.
2005/0059470 A1 3/2005 Cannon
2005/0059471 A1 3/2005 Cannon
2005/0064932 A1 3/2005 Cannon
2005/0075161 A1 4/2005 McGlone et al.
2005/0096119 A1 5/2005 Lind et al.
2005/0096123 A1 5/2005 Cregan et al.
2005/0101370 A1 5/2005 Lind et al.
2005/0101387 A1 5/2005 Wolf
2005/0119042 A1 6/2005 Chamberlain et al.
2005/0130730 A1 6/2005 Lind et al.
2005/0148382 A1 7/2005 Fox
2005/0164771 A1 7/2005 Lind et al.
2005/0164772 A1 7/2005 Lind et al.
2005/0164773 A1 7/2005 Lind et al.
2005/0167916 A1 8/2005 Banyai
2005/0187014 A1 8/2005 Saffari et al.
2005/0227753 A1 10/2005 Luciano, Jr.
2005/0255906 A1 11/2005 Lind et al.
2006/0084490 A1 4/2006 Khal
2006/0189375 A1 8/2006 Dodge
2007/0021185 A1 1/2007 Walker et al.
2007/0117611 A1 5/2007 Dodge
2008/0102952 A1 5/2008 Walker et al.
2008/0254894 A1 10/2008 Michaelson et al.
2009/0075715 A1 3/2009 Coleman et al.
2009/0197664 A1 8/2009 Schultz
2010/0120489 A1 5/2010 Meyer
2011/0028201 A1 2/2011 Warner et al.

* cited by examiner

PROXY SPOTS FEATURE FOR KENO GAMES

BACKGROUND

The present disclosure relates generally to wager-based games and more particularly to keno games. A keno game typically displays to a player a keno board with eighty numbered selection spots. A player wagers by selecting six numbers on the keno board. Next, twenty numbers are drawn from eighty possible numbers. The player is paid based on matches found between the drawn numbers and the six player-selected numbers on the keno board. For example, the player may have selected numbers 5, 21, 34, 36, 49, and 71 of which 5 and 21 match the numbers drawn by the keno game. A paytable may dictate the payout amount that is due to the player depending on the number of matches detected. For example, a paytable may indicate that if there are four matches, then the payout amount to the player is seven points.

SUMMARY

A method comprising displaying a keno board showing a set of available numbers; selecting, using one or more processors, a set of numbers, wherein the selected set of numbers is a subset of available numbers, and the selected set comprising a first sub-set of numbers and a second sub-set of numbers; for each number in the first sub-set of numbers, selecting, using the one or more processors, a number from the first sub-set of numbers to link to the number in the first sub-set of numbers; selecting, using the one or more processors, a set of drawn numbers from the set of available numbers; determining, using the one or more processors, hits by comparing the first sub-set of numbers and the second sub-set of numbers and the drawn numbers; and calculating, using the one or more processors, payout based on the determined hits.

An electronic device for playing a keno game, comprising a display configured to display the keno game to a player having a keno board with a first predetermined number of keno board spots; a user-input panel; and a game controller having one or more data processors and one or more storage devices storing instructions that, when executed by the one or more data processors, cause the one or more data processors to perform operations comprising: displaying a keno board showing a set of available numbers; selecting a set of numbers, wherein the selected set of numbers is a subset of available numbers, and the selected set comprising a first sub-set of numbers and a second sub-set of numbers; for each number in the first sub-set of numbers, selecting a number from the first sub-set of numbers to link to the number in the first sub-set of numbers; selecting a set of drawn numbers from the set of available numbers; determining hits by comparing the first sub-set of numbers and the second sub-set of numbers and the drawn numbers; and calculating payout based on the determined hits.

A computer-readable storage medium having machine instructions stored therein, the instructions being executable by a processor to cause the processor to perform operations comprising: displaying a keno board showing a set of available numbers; selecting a set of numbers, wherein the selected set of numbers is a subset of available numbers, and the selected set comprising a first sub-set of numbers and a second sub-set of numbers; for each number in the first sub-set of numbers, selecting a number from the first sub-set of numbers to link to the number in the first sub-set of numbers; selecting a set of drawn numbers from the set of available numbers; determining hits by comparing the first sub-set of numbers and the second sub-set of numbers and the drawn numbers; and calculating payout based on the determined hits.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims, in which:

DETAILED DESCRIPTION

Figure 1:
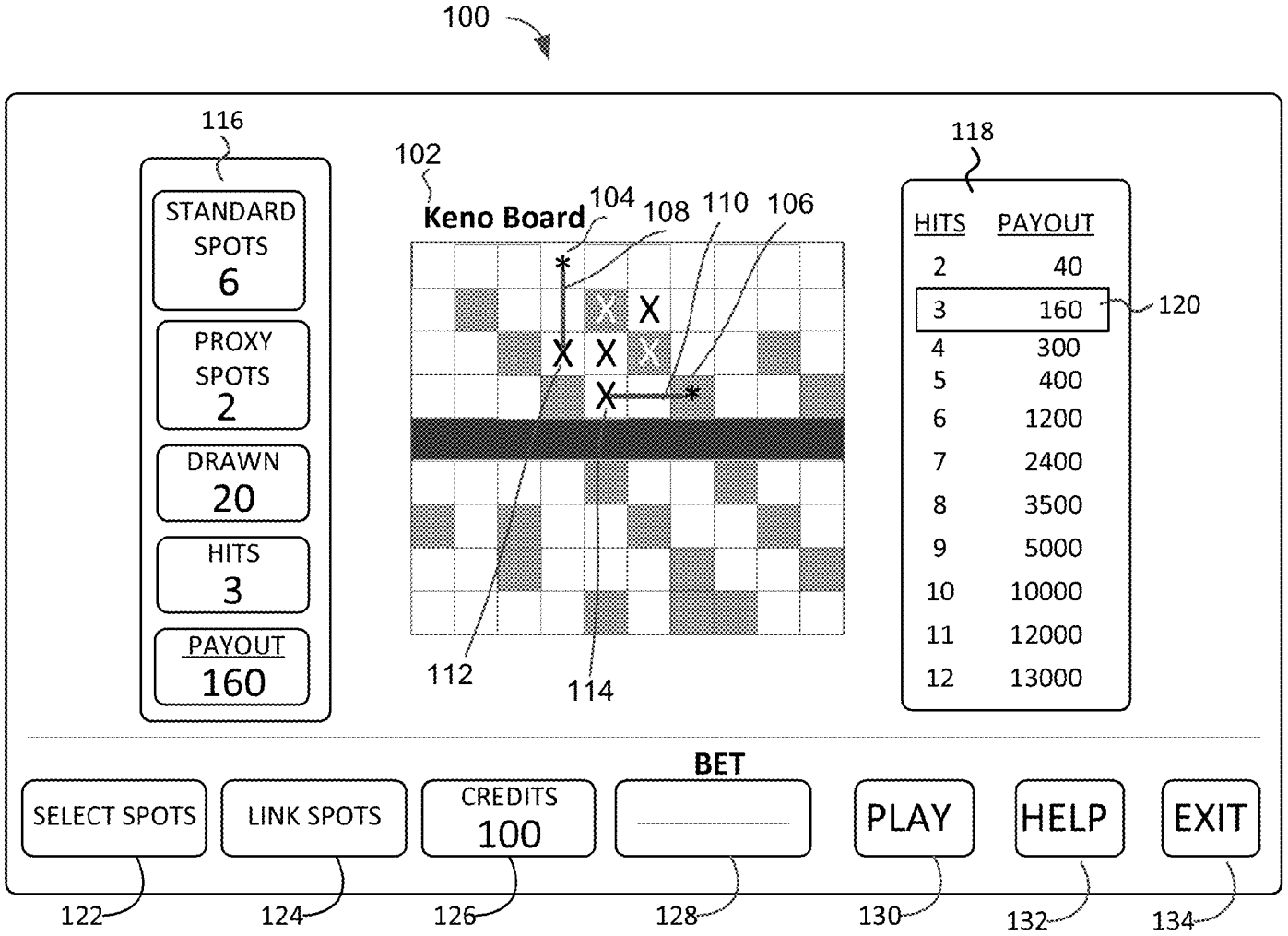
FIG. 1 is an illustration of a keno game allowing for selection of proxy keno spots in addition to standard keno spots, in an accordance with an example implementation.

Numerous specific details may be set forth below to provide a thorough understanding of concepts underlying the described embodiments. It may be apparent, however, to one skilled in the art that the described embodiments may be practiced without some or all of these specific details. In other instances, some process steps have not been described in detail in order to avoid unnecessarily obscuring the underlying concept.

According to various embodiments disclosed herein, a keno game allowing for selection of proxy spots in addition to standard player selected spots is provided. In one implementation, two to ten (or any other number as determined by the keno game) standard keno board spots as well as one or more proxy spots are randomly selected. In another implementation, the player selects the standard keno board spots and/or the proxy spots.

In some embodiments, the number of proxy spots that the player is allowed to select may depend on how many standard spots the player selected. A user interface may be provided for the user to manually select the proxy spots. The interface may allow for the selection of the proxy spots separately from the selected standard player keno spots. In one implementation, the first or last predetermined number of player spots may be designated as the proxy spots. In another implementation, the player may have the option to request that the keno game automatically generate the proxy spots and mark them on the keno board.

The proxy spots may be randomly linked to standard player selected spots. In another embodiment, a user interface may be provided enabling the player to select the links between the proxy spots and the standard player selected spots. A wire or another visual representation of a link may be placed between the proxy spots and one of the standard player selected spots. The proxy spots act as a substitute for the standard player-selected spots to which they are linked.

Once numbers are drawn (e.g., twenty numbers), if it is determined that a proxy spot matches one of the drawn numbers, the standard player-selected spot to which the proxy spot is linked is considered a hit. When a draw hits one of the proxy spots, then the visual representation of a link such as a wire may electrify and mark the other end of the link that terminates on a standard player selected spot counting this as a hit.

When both ends of the visual representation of the link (e.g., both ends of the wire) are drawn as hits during the draw, then a multiplier may be triggered. The multipliers may be tiered if more than one "pair" of proxy and standard player spots are drawn. For example, for one pair of a proxy spot and a standard player selected spot linked to the proxy spot are both drawn during the draw, a times two multiplier may be triggered, while two pairs may trigger a times three multiplier, etc. In some implementations, when both the standard spot and the proxy spot are hits, it may only count as one hit. The player may keep the same designated spots (i.e., standard player selected spots and/or proxy spots) or change them between each keno game.

In some implementations, the proxy spots themselves may not be directly counted toward the hit total. In these implementations, a multiplier may be triggered when both the proxy spot and the linked standard player selected spot numbers are drawn.

FIG. 1 illustrates a user interface for a keno game 100. A keno board 102 is displayed with eighty keno board spots. Although each spot in the keno board 102 is shown as a separate square, the keno board spots may be shown on the keno board 102 as numbered balls, numbered squares, or another visual representation. As shown, the player has selected six standard spots on the keno board 102. The player selected standard spots are shown on the keno board 102 with "X" marked over the corresponding keno board spot.

In one implementation, the player is allowed to also select a particular number of proxy spots on the keno board 102. As shown, in a summary section 116, the player is allowed to select two proxy spots. The number of proxy spots that the player can select may depend on the number of standard keno board spots that the player selects. A user interface may be provided to the player to select one or more proxy spots separately from selecting the standard player selected spots.

In one implementation, the number of proxy spots may be designated as the first or last predetermined number of the standard player selected spots. Thus, the player may select the total number of spots allowed, but a particular number of those spots (e.g., first spot, last two spots, etc.) would be designated as proxy spots. The proxy spots may be marked on the keno board using different visual indicators (e.g., "*" may be used for proxy spots and "X" for standard player selected spots). For example, if the total number of the standard player selected spots is eight, then the first two selected spots would be designated and marked as the proxy spots. In another example, the last two of the eight standard player selected spots may be designated and marked as the proxy spots.

Alternatively, the player may hit a select spots button 122, which would cause the keno game to randomly or pseudo-randomly select the standard spots and/or the proxy spots. As shown, the player selected six standard spots and two proxy spots 104 and 106. In one implementation, the first two of the eight selected spots by the player were designated as proxy spots and marked as proxy spots on the keno board. In another implementation, the user selects the six standard spots and the two proxy spots separately from each other. In another implementation, the proxy spots are randomly selected automatically without the player having to request the automatic selection of the proxy spots.

Upon the player selecting the proxy keno spots, the player may be allowed to draw a link between each proxy spot and a standard player selected spot. In one implementation, the player may request that the keno game automatically connect or link each proxy spot to another standard player selected spot. In particular, the player may hit on a connect spots button 124 to request these links to be generated and visually displayed on the keno board 102.

As shown, the proxy spot 104 is linked by a line 108 to a standard player selected spot 112, while the proxy spot 106 is linked by a line 110 to a standard player selected spot 114. As discussed above, the player may either manually indicate or draw these links, or request that the keno game generate and draw these links on the keno board. Although the link between each proxy spot and another standard player selected spot is shown as a line, any other visualization may be utilized to show links between proxy spots and standard player selected spots. For example, a "wire" visualization may be used for each link between a proxy spot and a standard player selected spot. In one implementation, a different visualization may be used for a link between each pair of proxy spot and standard player selected spot. In another implementation, the assignment of proxy spots to standard player selected spots may be shown in a table or an area of the keno game without showing any visual links on the keno board. For example, a table may have two columns, in which the first column may reference proxy spots, while the second column may reference standard player selected spots. In this example, under the first column, a ball number of the first proxy spot (e.g., ball numbered 5) may be shown, while in the second column of the same row, a corresponding standard player selected ball number is shown (e.g., ball numbered 20).

Twenty numbers are randomly drawn by the keno game and the color of the keno board squares that correspond to the drawn numbers is updated to a grey color. Any other visual indicators other than the grey squares may be used to signify the drawn spots. Out of the six standard player selected spots, two spots match the drawn spots and are considered "hits". In addition, one of the two proxy spot 106 matches one of the drawn numbers as shown by the grey background of the corresponding keno spot. The standard player-selected spot 114 does not match any of the drawn numbers, but is linked by the line 110 to the proxy spot 106 which does match one of the drawn numbers. The proxy spot 106 itself is not directly considered a hit, but instead acts as a substitute for the standard player selected spot 114 to which it is connected. As a result, the standard player-selected spot 114 is considered a "hit" by virtue of the proxy spot 106 matching one of the drawn numbers. Thus, a total of three "hits" are detected on the keno board.

A payout for the three detected "hits" needs to be provided to the player. A paytable 124 specifies the payout due to the player for the various possible numbers of "hits". For example, for the three detected "hits", the payout due to the player is 160 credits. In one implementation, the paytable 118 may be used for determining payout based on matches between the standard player-selected spots and drawn numbers, while a separate paytable (not shown) may be provided for determining payout for "hits" identified as a result of the selected proxy spots matching one or more drawn numbers. In this implementation, the sum of the payout provided by the two paytables may provide the total payout for the player. In another implementation, when more than a predetermined number of (e.g., more than three) proxy spots match drawn number(s), a multiplier may be determined based on the total number of proxy spots being hit by draws.

In this implementation, the number of credits due to the player may be calculated based on the hits detected using the standard player-selected spots and/or proxy spots and multiplied by the determined multiplier.

Various keno game information are provided to the player in a game summary section 116. In particular, the summary section 116 displays that 6 standard spots were marked by the player on the keno board, 20 spots were drawn, 2 proxy spots were selected, 3 "hits" were detected, and that, as a result, 160 credits are paid to the player. A bottom section of the keno game 100 displays a total number of credits earned by the player (field 126). The player can also enter the bet in a field 128 for playing the next keno game or the next keno game round. Buttons 130, 132, and 134 are provided to enable the player to play, get help, or exit the keno game respectively.

Figure 2:
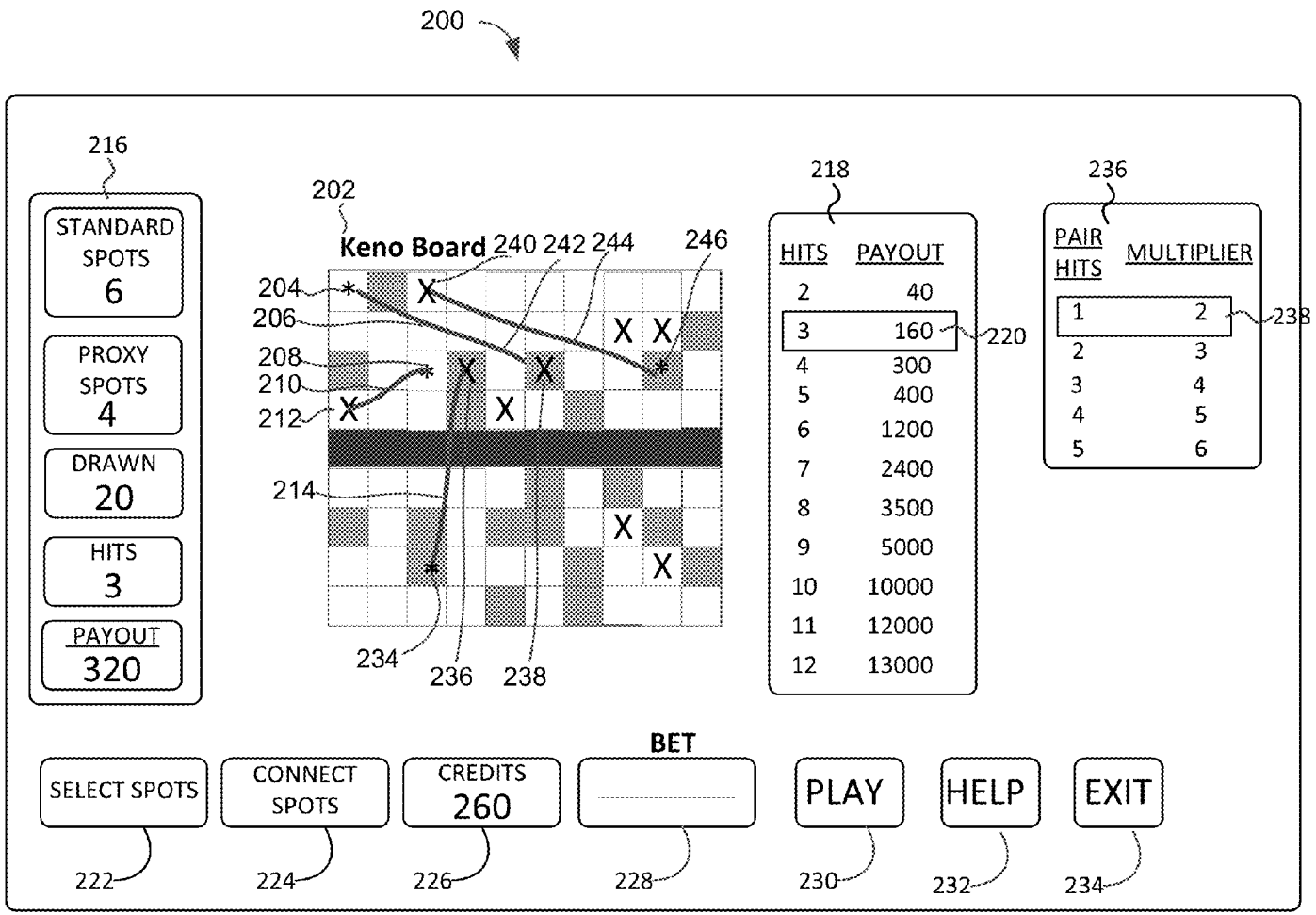
FIG. 2 is an illustration of a keno game allowing for selection of proxy keno spots, where both a proxy spot and a standard spot linked to the proxy spot are hits, in an accordance with an example implementation.

FIG. 2 illustrates a user interface for a keno game 200 during which a pair of linked proxy spot and standard player selected spot are drawn. A keno board 202 is displayed with eighty keno board spots shown as squares. During the keno game 200, nine standard spots and four proxy spots are randomly selected by the keno game 200 or selected manually by the player on the keno board 202. In one implementation, the four proxy spots are the first four spots in the thirteen spots that are automatically selected or selected by the player. In this implementation, the first four spots in the player selected or automatically selected thirteen spots are designated as the proxy spots. In another implementation, the four proxy spots are the last four spots in the thirteen spots that are automatically selected or selected by the player. In another implementation, the four proxy spots are randomly designated as the proxy spots from the thirteen spots that are automatically selected or selected by the player.

In other implementations, the player utilizes a user interface enabling the player to separately select the nine standard spots and the four proxy spots. The proxy spots and/or the standard player selected spots may be automatically selected by the keno game for the player. In this implementation, the player may select (e.g., by click on, tapping on, etc.) the select spots button 222, which triggers random or pseudo-random selection of proxy spots and/or random spots. When the keno game randomly generates both the proxy spots and the standard spots, it may first randomly or pseudo-randomly generate all the spots and then designate a sub-set of those spots as proxy spots.

As shown in FIG. 2, the standard player selected spots are marked on the keno board 202 using "X" visual indicator over the corresponding keno board spots, while the proxy spots are marked on the keno board 202 using the "*" visual indicator. As a result, the proxy spots and the standard player selected spots can be visually distinguished for the player. Any other visualizations can be used to show the standard player selected spots as well as the selected proxy spots.

The proxy spots are then linked to the standard player selected spots, with each proxy spot being linked to one standard player selected spot. The player may manually select the links between the proxy spots and the standard player selected spots. For example, the player may click on, tap on, or otherwise select a proxy spot drawn on the keno board 202 and indicate which of the player selected keno spots (e.g., by clicking on, tapping on, or otherwise selecting a standard player selected spot) to link the proxy spot to. Once the player selects a pair of a proxy spot and a standard player selected spot, a link between the two may be visually drawn on the keno board. As shown, lines 214, 206, and 244 are drawn to connect the proxy spots to standard player selected spot.

The player can also request that the proxy spots are automatically linked to standard player selected spots by selecting the connect spots button 224. As a result of the player request, the keno game may randomly or pseudo-randomly identify a standard player selected spot for each proxy spot. For example, the keno game may select a standard player selected spot (e.g., spot 238) for the for the proxy spot 204 by randomly or pseudo-randomly selecting one of the spots from the available nine standard player selected spots. In this example, next, the keno game may select a player select spot for the proxy spot 208 but from the remaining eight standard player selected spots (i.e., not counting the spot 238 which is already linked to the proxy spot 204). Next, the keno game may determine a standard player selected spot for the proxy spot 246 from the remaining seven player select spots not including the two standard player selected spots that were already assigned to the proxy spots 204 and 208. Finally, the keno game may determine a standard player selected spot for the proxy spot 234 from the remaining six player select spots not including the three standard player selected spots that were already assigned to the proxy spots 204, 208 and 246. Thus, the keno game may select a standard player selected spot for a proxy spot from a pool of standard player selected spots that exclude the spots that were already selected for the other proxy spots. In another implementation, the links are automatically generated and marked on the keno board without waiting for the player request for automatic generation of links. In this implementation, the links may be generated and shown on the keno board after the standard and proxy spots are marked on the keno board.

In other embodiments, multiple proxy spots may be linked to the same standard player selected spot, in which case the payout to the player when one or more of those proxy spots are hit by draws may be calculated in part based on how many proxy spots are linked to the standard player selected spot to which this proxy spot is linked. In other embodiments, at least one proxy spot can be linked to more than one standard player selected spot. For example, for a single proxy spot, the player may be able to connect it to a particular number of standard player selected spots, and if that proxy spot is hit by a draw, the player receives a bonus or another type of special award (e.g., credits, free plays, multipliers, or any combination thereof).

As shown, the proxy spot 204 is linked by a line 206 to a standard player selected spot 238, while the proxy spot 208 is linked by a line 210 to a standard player selected spot 212. In addition, the proxy spot 246 is linked by a line 244 to a standard player selected spot 240, and the proxy spot 234 is linked by a line 214 to a standard player selected spot 236. Although the link between each proxy spot and another standard player selected spot is shown as a line, any other visualization may be utilized to show links between proxy spots and standard player selected spots. For example, wires, strings, railroad tracks, or any other visualization may be used for each link between a proxy spot and a standard player selected spot. The same or different connectors can be used to show the link between different pairs of proxy spots and standard player selected spots.

Twenty numbers are randomly or pseudo-randomly drawn and marked on the keno board using grey color in the corresponding keno board spots. Any other visualizations may be used to displays to the user drawn numbers. For example, other colors may be used to emphasize the keno board spots that correspond to the drawn numbers. As shown, the second keno board spot from the left in the first row was drawn. In other words, number "2" was drawn out of the eighty available numbers, which resulted in the background color of the keno board spot being colored in grey. When a drawn spot is marked on the keno board and it matches a proxy spot, then the connector (e.g., the line) between the proxy spot and the standard player selected spot may be visually emphasized to the player (e.g., the connector might light up or display an animation) that by virtue of the proxy spot being hit by a draw, the standard player selected spot to which it is linked is considered a hit. Thus, the proxy spot itself is not directly considered a hit and does not count toward the total number of hits.

Out of the nine spots selected by the player, two standard player selected spots match the drawn numbers as shown in the corresponding keno board spots 236 and 238. In addition, two of the proxy spots 234 and 246 match drawn numbers. As shown, the proxy spot 246 is linked to the standard player selected spot 240 by a line 244. Thus, because the proxy spot 246 is hit by a draw, it causes the linked standard player selected spot 240 to qualify as a hit, which increases the total number of hits to three hits. As a result, a total of three "hits" are detected including the spots 236, 238 and the spot 240 (as a result of the proxy spot 246 being hit by a draw).

The proxy spot 234 is linked to the standard player selected spot 236 by a line 214. Both the proxy spot 234 and the standard player selected spot 236 match drawn numbers. In one embodiment, because both linked spots in the pair of proxy spot 234 and standard player selected spot 236 are hit by draws, and the standard player selected spot 236 directly counts as a "hit", the proxy spot 234 itself does not count as a "hit" but instead a multiplier may be triggered. The multipliers may be tiered if more than one pair of proxy and standard player selected spots are drawn as shown in a multiplier table 236. In particular, when one pair of proxy spot and standard player selected spot are hit by draws, the table 236 dictates that a multiplier with a value of 2 is used. This multiplier may be applied to the number of credits earned during the keno game. Thus, the multiplier with a value of 2 is applied to the total number of credits earned for the three detected hits. Accordingly, as shown in FIG. 2, the player is awarded 320 credits (i.e., 160 credits multiplied by 2).

In other embodiments, the player may receive a hit for the proxy spot 234 even though the linked standard player selected spot is also a hit. Thus, due to the proxy spots matching, the player receives two additional hits, which would bring the total number of hits to 4. For a total of 4 hits, the payout to the player would be 300 credits. In other embodiments, when a pair of linked player selected keno board spot and a proxy spot are both hit by draws, any combination of additional credits, a multiplier, free additional plays, bonus round, and/or any other award may be awarded to the player. A proxy spot or a standard player selected spot being hit by draws means that those spots match the draws.

One or more paytables (not shown), in addition to or in place of the tables 218 and 236, may be displayed to the player, which identify awards (e.g., credits, multiplier, free plays, or any combination thereof) for various numbers of linked pairs of proxy spots and standard player selected spots. For example, a paytable may dictate that if a proxy spot is a hit by a draw, then the player is entitled to ten additional points, while when two proxy spots are hits by draws, the player is entitled to forty additional points. In this example, the paytable may indicate that when both spots in pair of linked proxy spot and standard player selected spot are hits, the player is entitled to 50 credits, and that for two such pairs, the additional payout is 100 credits, and so forth.

A summary section 216 provides information about the keno game. For example, as shown, the summary section 216 indicates that the player can mark up to 9 spots, as well up to four proxy spots. The summary section 216 displays that twenty spots are drawn. The summary section also shows results of the keno game including the total number of hits found and the payout to the player. The number of hits may include both the hits from matches between drawn spots and the standard player selected spots as well as for matches between drawn spots and proxy spots. At the end of the keno game 200, the summary section 216 is updated to show that three hits were identified. Thus, as shown in the payout table 218 and the summary section, the player is owed 320 credits for the total of three hits (i.e., 160 credits for three hits are multiplied by a multiplier with a value of 2).

The total number of credits 226 was updated to reflect the payout from the previous keno game. Although not shown, the total number of credits 226 is updated to account for 320 credits earned by the player during the keno game 202. Because two of the proxy spots matching the drawn spots, the player earned additional credits.

Various keno game information can be provided to the player at the bottom of the keno game screen (or in any other location on the screen). For example, the total number of credits earned by the player field 226 displays the total number of credits earned. The player can also enter a bet in a field 228. Buttons 230, 232, and 34 enable the player to play, get help, or exit the keno game respectively. The spots button 222 enables the player to request the keno game to select the proxy spots and/or the standard spots and label them on the keno board 102. Pressing the connect spots button 224 triggers the keno game to automatically visually connect each proxy spot to a standard player selected spot on the keno board. In some embodiments, the proxy spots and the links between proxy spots and the standard spots are automatically generated by the keno game and marked on the keno board.

Figure 3:
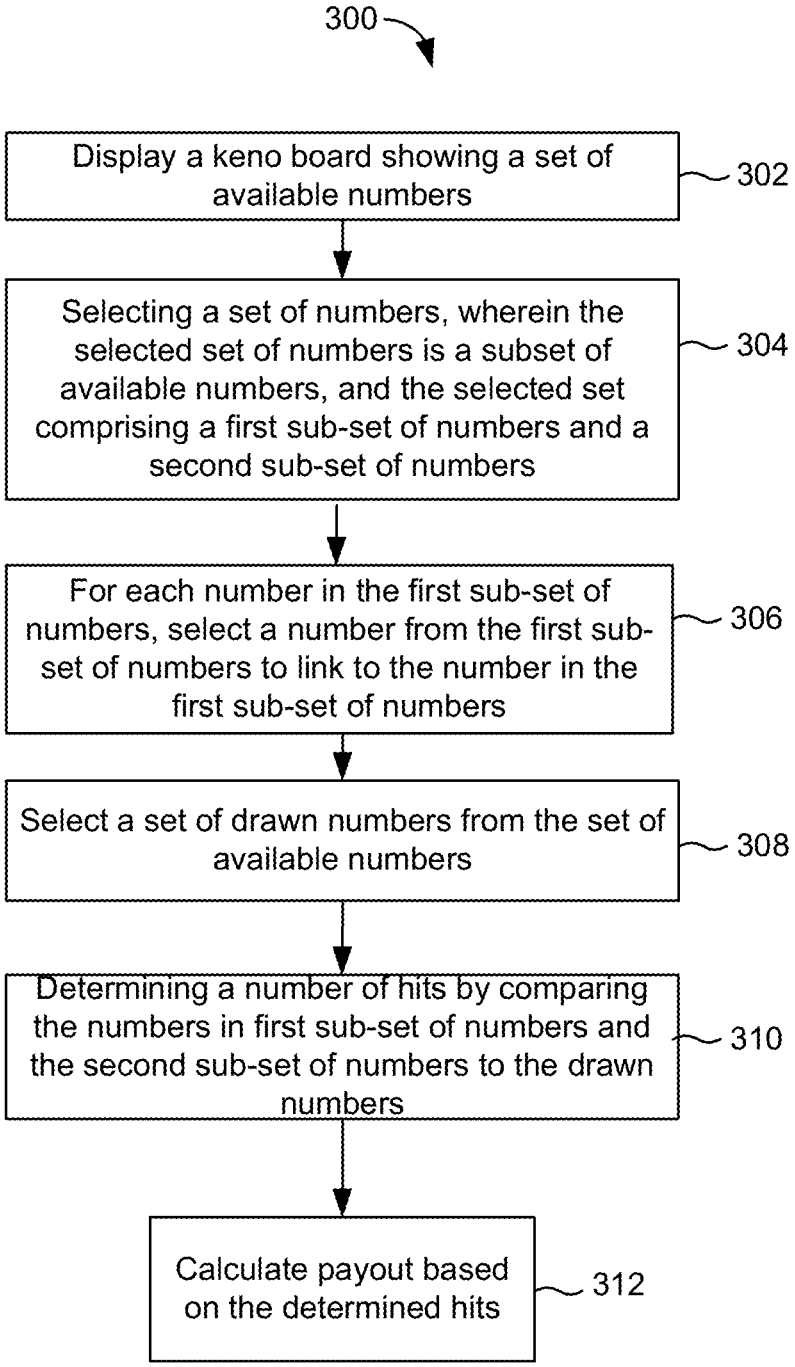
FIG. 3 is a flow diagram of a process for providing a keno game that allows for selection of proxy keno spots, in an accordance with an example implementation.

FIG. 3 is a flow diagram of a process 300 for providing a keno game that allows for selection of proxy spots in accordance with an illustrative embodiment. The process 300 can be implemented on a computing device (e.g., a gaming machine, a user device, etc.). In one embodiment, the process 300 is encoded on a computer-readable medium that contains instructions that, when executed by the computing device, cause the computing device to perform operations of the process 300.

The process 300 includes displaying (block 402) a keno board having a set of available numbers. The set of available numbers may be visually illustrated on the keno board as numbered balls, numbered squares, or any other numbered shapes or images, etc. For example, each keno board ball shown on the keno board may be labeled with a unique number between one and the number of available numbers (e.g., eighty). The set of available numbers may include eighty unique numbers or any other number of unique numbers (e.g., one hundred unique numbers from one to one hundred).

At block 304, a set of numbers is selected. The selected set of numbers is a subset of the set of available numbers. The selected set of numbers may include a first sub-set of numbers and a second sub-set of numbers. The first sub-set of numbers may the first numbers in the selected set of numbers, while the second sub-set of numbers may be the remaining numbers in the selected set of numbers. In one implementation, the set of numbers may be randomly or pseudo-randomly selected from the set of available numbers. In another implementation, the set of numbers is selected by the player using a user interface.

The first sub-set of numbers may be accordingly be designated as the proxy numbers or spots on the keno board (e.g., using the "*" symbol as shown in FIGS. 1-2), while the second sub-set of numbers may be designated on the keno board (e.g., using the "X" symbol as shown in FIG. 102) as standard selected numbers. For example, nine spots may be randomly selected (or selected by the player), of which the first three would be designated as proxy spots. In this example, the first subset of numbers would include the first three spots from the nine spots, and the second subset of numbers would include the remaining six spots.

The first sub-set of numbers may act as substitutes for the numbers in the second sub-set of numbers to which they are linked. In other word, when a number in the first sub-set of numbers is a hit (i.e., the number matches a drawn number), a number in the second sub-set of numbers it is linked to is considered a hit or match. The numbers in the first sub-set of numbers would not directly count toward a hit total.

In other embodiments, a user interface may be provided to the player to select the first sub-set of numbers and the second sub-set of numbers separately. For example, the player could first select four standard spots, and then select two proxy spots on the keno board. The first sub-set of numbers and the second sub-set of numbers would be marked using different visual indicators as to emphasize two types of marks to the player (e.g., using "*" and "X" as shown in FIG. 1).

In other embodiments, the first sub-set of numbers may be selected by the player, while the second sub-set of numbers may be randomly generated. Alternatively, the first sub-set of numbers may be randomly generated, while the second sub-set of numbers may be selected by the player.

At block 306, for each number in the first sub-set of numbers, a number is selected from the second sub-set of numbers to link to the number in the first sub-set of numbers. In some embodiments, the player may select a number in the second sub-set to link to a number in the first sub-set. In other embodiments, this selection may be automatically performed by the keno game (e.g., randomly or pseudo-randomly). As a result, each number in the first sub-set of numbers is linked to a number in the second sub-set of numbers. These links may be visually displayed to the player on the keno board (e.g., using wires that run between the linked keno board spots).

A set of drawn numbers is selected from the set of available numbers (block 310). In some embodiments, the set of drawn numbers may be randomly selected without replacement from the available numbers. In one implementation, twenty numbers may be randomly selected from available eighty numbers as shown in FIGS. 1 and 2. In another implementation, the first set of numbers may be randomly selected with replacement from the available numbers.

The display of the keno board is updated with the selection of the set of drawn numbers, the selected first sub-set of numbers, the selected second sub-set of numbers, and visual links linking each number in the first sub-set of numbers to a selected number in the second sub-set of numbers. The keno board may be updated by marking the keno board spots corresponding to the selected set of drawn numbers, the selected first sub-set of numbers, the selected second sub-set of numbers, and the visual links using one or more visual indicators. As shown in FIGS. 1 and 2, the selections of the first sub-set of numbers can be shown with "X"s over the corresponding keno board spots, while the selections of the second sub-set of numbers can be shown with "*"s over the corresponding keno board spots. The drawn numbers may be shown as grey colored squares, while the visual links between proxy spots and standard selected spots (i.e., between numbers in the second sub-set of numbers and the numbers in the first sub-set of numbers) may be shown as lines or any other connectors. In one implementation, the set of drawn numbers may be displayed on the keno board as "ball drops".

A number of hits is determined (block 312) by comparing the selected numbers and the set of drawn numbers. A second set of one or more matches is identified (block 316) by comparing the first sub-set of numbers and the second sub-set of numbers to the drawn numbers. Each match between the second sub-set of numbers and the drawn number may count as a hit for the total number of hits. When, a match between a number in the first sub-set of numbers and the drawn numbers is detected, a number in the second sub-set of numbers that is linked to the number in the first sub-set of numbers qualifies as a "hit". Thus, the number in the first sub-set of numbers that matches a drawn numbers does not directly count toward the total number of hits.

If a number from the first sub-set is linked to a number from the second sub-set, and both of the numbers in the pair match drawn numbers, one hit may be awarded, and a multiplier may be triggered. The multiplier may be determined using a paytable that specifies multiplier value for various numbers of pairs in which both numbers are hits. For example, the paytable may specify that for one pair of numbers in which both numbers are hits, the multiplier value is 2.

The keno board may be updated to visually display to the detected matches. In some embodiments, various attributes associated with the corresponding keno spots may be updated to emphasize to the user the first set of matches and the second set of matches. In one implementation, different background colors (or another keno spot attribute) of the corresponding keno game spots may be used to identify the matches in the first set of matches as compared to the matches in the second set of matches.

At block 312, the payout due to the player may be calculated based on the identified hits. The total number of hits may be determined as described with respect to block 310 and throughout this disclosure. Based on the total number of identified hits, a number of credits or another award that is due to the player may be determined. For example, a paytable may be utilized to determine the number of credits based on the total number of hits. If a multiplier was triggered, the multiplier may be applied to the total number of credits earned by the player for the detected hits.

Figure 4:
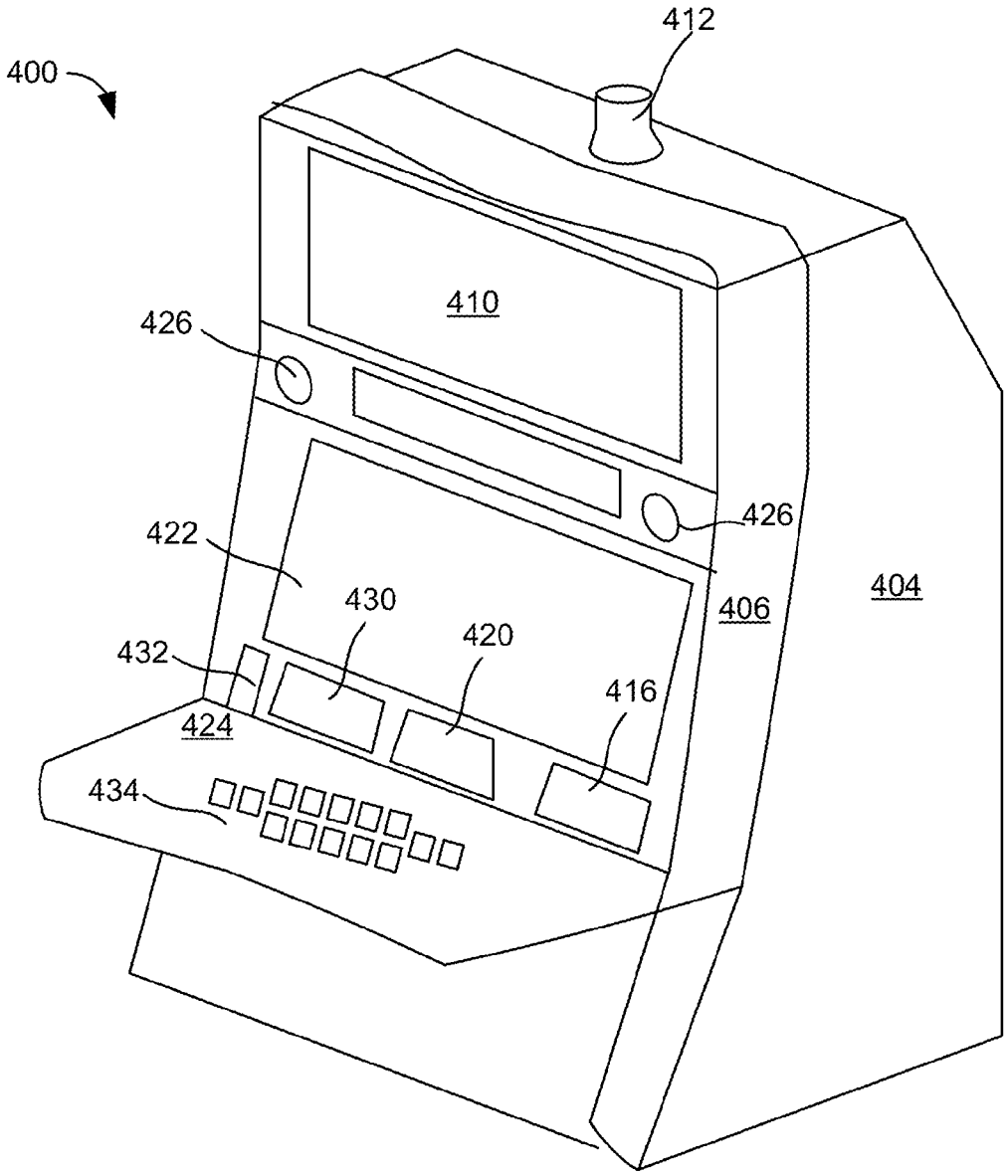
FIG. 4 is a diagram of an electronic gaming machine that can be used to play the keno game, in an accordance with an example implementation.

Referring to FIG. 4, a perspective drawing of an electronic gaming machine 400 is shown in accordance with described embodiments. The gaming machine 400 may include a main cabinet 404. The main cabinet 404 may provide a secure enclosure that prevents tampering with device components, such as a game controller (not shown) located within the interior of the main cabinet 404. The main cabinet 404 may include an access mechanism, such as a door 406, which allows the interior of the gaming machine 400 to be accessed. Actuation of the door 406 may be controlled by a locking mechanism. In some embodiments, the locking mechanism, the door 406, and the interior of main cabinet 404 may be monitored with security sensors of various types to detect whether the interior has been accessed. For instance, a light sensor may be provided within the main cabinet 404 to detect a change in light-levels when the door 406 is opened and/or an accelerometer may be attached to the door 406 to detect when the door 406 is opened.

The gaming machine 400 may include any number of user interface devices that convey sensory information to a user and/or receive input from the user. For example, the gaming machine 400 may include electronic displays 440 and/or 422, speakers 426, and/or a candle device 412 to convey information to the user of the gaming machine 400. The gaming machine 400 may also include a console 424 having one or more inputs (e.g., buttons, track pads, etc.) configured to receive input from a user. In one embodiment, the display 410 and/or the display 422 may be a touch screen display configured to receive input from a user. A controller (not shown) within the gaming machine 400 may run a game, such as a wager-based game (e.g., a keno game), in response to receiving input from a user via inputs located in the console 424, display 422, or display 410. For example, inputs located in the console 424 may be operated to place a wager in the game and to run the game. In response, the controller may cause the display 422 to show a wager-based game such as a keno game.

The gaming machine 400 may also include devices for conducting a wager-based game. For example, the gaming machine 400 may include a ticket acceptor 416 and a printer 420. In various embodiments, the gaming machine 400 may be configured to run on credits that may be redeemed for money and/or other forms of prizes. The ticket acceptor 416 may read an inserted ticket having one or more credits usable to play a game on the gaming machine 400. For example, a player of the gaming machine 400 may wager one or more credits within a video keno game. If the player loses, the wagered amount may be deducted from the player's remaining balance on the gaming machine 400. However, if the player wins and is awarded an award, the player's balance may be increased by the amount won and/or awarded. Any remaining credit balance on the gaming machine 400 may be converted into a ticket via the printer 420. For example, a player of the gaming machine 400 may cash out of the machine by selecting to print a ticket via the printer 420. The ticket may then be used to play other gaming machines or redeemed for cash and/or prizes. According to various embodiments, the gaming machine 400 may record data regarding its receipt and/or disbursement of credits.

In one embodiment, the gaming machine 400 may include a loyalty card acceptor 430. In general, a loyalty card may be tied to a user's loyalty account. A loyalty account may store various information about the user, such as the user's identity, the user's gaming preferences, the user's gaming habits (e.g., which games the user plays, how long the user plays, etc.), or similar information about the user. A loyalty account may also be used to reward a user for playing the gaming machine 400. For example, a user having a loyalty account may be given an award turn on the gaming machine 400 or credited loyalty points for playing the gaming machine 400. Such loyalty points may be exchanged for loyalty rewards (e.g., a free meal, a free hotel stay, free room upgrade, discounts, etc.).

Implementations of the subject matter and the operations described in this specification can be implemented in digital electronic circuitry, computer software, firmware or hardware, including the structures disclosed in this specification and their structural equivalents or in combinations of one or more of them. Implementations of the subject matter described in this specification can be implemented as one or more computer programs, i.e., one or more modules of computer program instructions, encoded on one or more computer storage medium for execution by, or to control the operation of data processing apparatus. Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, or other storage devices). Accordingly, the computer storage medium may be tangible and non-transitory.

The operations described in this specification can be implemented as operations performed by a data processing apparatus on data stored on one or more computer-readable storage devices or received from other sources.

The term "client or "server" includes a variety of apparatuses, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application-specific integrated circuit). The apparatus can also include, in addition to hardware, a code that creates an execution environment for the computer program in question, e.g., a code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interlinked by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, or a portable storage device (e.g., a universal serial bus (USB) flash drive). Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented on a computer having a display device, e.g., a CRT (cathode ray tube), LCD (liquid crystal display), OLED (organic light emitting diode), TFT (thin-film transistor), plasma, other flexible configuration, or any other monitor for displaying information to the user and a keyboard, a pointing device, e.g., a mouse, trackball, etc., or a touch screen, touch pad, etc., by which the user can provide input to the computer. Other kinds of devices can be used to provide for interaction with a user as well. For example, feedback provided to the user can be any form of sensory feedback, e.g., visual feedback, auditory feedback, or tactile feedback and input from the user can be received in any form, including acoustic, speech, or tactile input. In addition, a computer can interact with a user by sending documents to and receiving documents from a device that is used by the user. For example, by sending webpages to a web browser on a user's client device in response to requests received from the web browser.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interlinked by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown, in sequential order or that all illustrated operations be performed to achieve desirable results. In certain circumstances, multitasking and parallel processing may be advantageous. Moreover, the separation of various system components in the implementations described above should not be understood as requiring such separation in all implementations and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing may be utilized.

What is claimed is:

1. A method of operating a gaming system, the method comprising:

(a) receiving, by an acceptor, a physical item associated with a monetary value;

(b) establishing, by one or more processors, a credit balance based at least in part on the monetary value associated with the received physical item;

(c) displaying, by at least one display device, a keno board including a set of available numbers;

(d) receiving an actuation of a wager button;

(e) placing, by the one or more processors, a wager in response to said actuation of the wager button, said wager being deductable from the credit balance;

(f) receiving, by at least one input device, a first selection of a player number set including one or more of a set of available numbers;

(g) associating, by the one or more processors, a proxy number with one of the one or more numbers of the player number set, wherein the proxy number is different from the number in the player number set with which it is associated;

(h) randomly selecting, using the one or more processors, a set of drawn numbers from the set of available numbers;

(i) determining, by the one or more processors, a quantity of hits by comparing the player number set and the proxy number with the drawn numbers, wherein the one of the one or more numbers in the player number set is hit if:

(i) said number matches one of the drawn numbers; or (ii) the proxy number associated with that number matches one of the drawn numbers;

(k) determining, by the one or more processors, any award based on a total quantity of hits and displaying, by the at least one display device, the determined award, the credit balance being increasable by the determined award; and (l) initiating, by the one or more processors, a payout associated with the credit balance following receipt of an actuation of a cashout button.

2. The method of claim 1, further comprising displaying, by the at least one display device and after associating the proxy number with the one of the one or more numbers of the player number set, a visual link between the number in the player number set and the associated proxy number.

3. The method of claim 1, which includes increasing, by the one or more processors and when the proxy number and the number in the player number set associated with the proxy number each match drawn numbers, the determined award using a multiplier.

4. The method of claim 1, which includes receiving, by the at least one input device, a second selection including the proxy number.

5. The method of claim 1, which includes randomly selecting, by the one or more processors, the proxy number from the set of available numbers not in the player number set.

6. A gaming system comprising:

a housing;

a display device supported by the housing;

a plurality of input devices supported by the housing and including an acceptor; and a game controller having one or more data processors and one or more storage devices storing instructions that, when executed by the one or more data processors, cause the one or more data processors to operate with the display device and the plurality of input devices to:

(a) establish a credit balance based at least in part on a monetary value associated with a physical item after the physical item is received by the acceptor;

(b) display a keno board including a set of available numbers;

(c) place a wager following receipt of an actuation of a wager button, said wager being deductable from the credit balance;

(d) associate a proxy number with one of one or more numbers of a player number set, wherein the player number set is selected from a set of available numbers and the proxy number is different from the number in the player number set with which it is associated;

(e) randomly select a set of drawn numbers from the set of available numbers;

(f) determine a quantity of hits by comparing the player number set and the proxy number with the drawn numbers, wherein the one of the one or more numbers in the player number set is hit if:

(i) said number matches one of the drawn numbers; or (ii) the proxy number associated with that number matches one of the drawn numbers;

(g) determine any award based on a total quantity of hits and display the determined award, the credit balance being increasable by the determined award; and (h) initiate a payout associated with the credit balance following receipt of an actuation of a cashout button.

7. The gaming system of claim 6, wherein the instructions, when executed by the one or more data processors, cause the one or more data processors to operate with the display device to, after associating the proxy number with the one of the one or more numbers of the player number set, display a visual link between the number in the player number set and the associated proxy number.

8. The gaming system of claim 6, wherein the instructions, when executed by the one or more data processors, cause the one or more data processors to, when the proxy number and the number in the player number set associated with the proxy number match drawn numbers, increase the determined award using a multiplier.

9. The gaming system of claim 6, wherein the proxy number is player-selected.

10. The gaming system of claim 6, wherein the instructions, when executed by the one or more data processors, cause the one or more data processors to randomly select the proxy number from the set of available numbers not in the player number set.

11. A non-transitory computer-readable storage medium having machine instructions stored therein, the instructions being executable by a processor to cause the processor to:

(a) establish a credit balance based at least in part on a monetary value associated with a physical item after an acceptor receives the physical item;

(b) cause a display device to display a keno board including a set of available numbers;

(c) place a wager following receipt of an actuation of a wager button, said wager being deductable from the credit balance;

(d) associate a proxy number with one of one or more numbers of a player number set, wherein the player number set is selected from a set of available numbers and the proxy number is different from the number in the player number set with which it is associated;

(e) randomly select a set of drawn numbers from the set of available numbers;

(f) determine a quantity of hits by comparing the player number set and the proxy number with the drawn numbers, wherein the one of the one or more numbers in the player number set is hit if:

(i) said number matches one of the drawn numbers; or (ii) the proxy number associated with that number matches one of the drawn numbers;

(g) determine any award based on a total quantity of hits and cause the display device to display the determined award, the credit balance being increasable by the determined award; and (h) initiate a payout associated with the credit balance following receipt of an actuation of a cashout button.

12. The non-transitory computer readable medium of claim 11, wherein the proxy number is player-selected.

13. The non-transitory computer readable medium of claim 11, wherein the instructions, when executed by the processor, cause the processor to randomly select the proxy number from the set of available numbers not in the player number set.

* * * * *